US007202882B2

(12) United States Patent
Morita

(10) Patent No.: US 7,202,882 B2
(45) Date of Patent: Apr. 10, 2007

(54) LIQUID CRYSTAL DISPLAY DEVICE

(75) Inventor: Toshiyuki Morita, Tokyo (JP)

(73) Assignee: NEC Corporation, Tokyo (JP)

( * ) Notice: Subject to any disclaimer, the term of this patent is extended or adjusted under 35 U.S.C. 154(b) by 259 days.

(21) Appl. No.: 10/177,016

(22) Filed: Jun. 24, 2002

(65) Prior Publication Data

US 2002/0196221 A1 Dec. 26, 2002

(30) Foreign Application Priority Data

Jun. 25, 2001 (JP) ..... 2001-192076
May 21, 2002 (JP) ..... 2002-146165

(51) Int. Cl.
*G09G 5/02* (2006.01)

(52) U.S. Cl. ..... 345/698; 345/87; 345/88; 345/81; 345/90; 345/534; 345/535

(58) Field of Classification Search ..... 345/30, 345/50, 55, 204, 208–209, 690, 87–90, 534–535; 382/195–198
See application file for complete search history.

(56) References Cited

U.S. PATENT DOCUMENTS 4,205,341 A * 5/1980 Mitsuya et al. ..... 375/240.24
5,646,641 A * 7/1997 Okamura et al. ..... 345/8
5,844,533 A * 12/1998 Usui et al. ..... 345/89
5,892,493 A * 4/1999 Enami et al. ..... 345/94
6,084,561 A * 7/2000 Kudo et al. ..... 345/89
6,121,952 A * 9/2000 Igari ..... 345/690
6,259,813 B1 * 7/2001 Ouchi ..... 382/195
6,388,727 B1 * 5/2002 Kim et al. ..... 349/141
6,414,664 B1 * 7/2002 Conover et al. ..... 345/89
6,552,710 B1 * 4/2003 Shimizu et al. ..... 345/100
2001/0035850 A1 * 11/2001 Okamoto et al. ..... 345/77
2001/0038372 A1 * 11/2001 Lee ..... 345/89

FOREIGN PATENT DOCUMENTS

JP 10-039837 2/1998
JP 11-352936 12/1999

OTHER PUBLICATIONS

Korean Office Action dated Jan. 21, 2005 (with partial English translation).

* cited by examiner

*Primary Examiner*—Richard Hjerpe
*Assistant Examiner*—Leonid Shapiro
(74) *Attorney, Agent, or Firm*—McGinn IP Law Group, PLLC

(57) ABSTRACT

A liquid crystal display device employing an overshooting driving method is provided which is capable of reducing memory capacity of a frame memory used to delay input data. The above liquid crystal display device for displaying an image using a liquid crystal panel includes a data converting table to generate output gray-scale data obtained by thinning out input gray-scale data to reduce a number of bits of input gray-scale data, a frame memory to generate second input gray-scale data by delaying output gray-scale data in a data converting table by one frame image display period in a liquid crystal panel and a look-up table to generate an overshooting gray-scale output being in advance stored according to a relation in size between the first input gray-scale data and the second input gray-scale data, wherein image display is performed by an overshooting gray-scale output in a liquid crystal panel.

21 Claims, 14 Drawing Sheets

*FIG.5*

*data of input 1 (8 bits)* →

| | | | | |
|---|---|---|---|---|
| 0 | ~ | 11 | → | 0 |
| 12 | ~ | 27 | → | 1 |
| 28 | ~ | 42 | → | 2 |
| 43 | ~ | 57 | → | 3 |
| 58 | ~ | 73 | → | 4 |
| 74 | ~ | 90 | → | 5 |
| 91 | ~ | 107 | → | 6 |
| 108 | ~ | 123 | → | 7 |
| 124 | ~ | 133 | → | 8 |
| 134 | ~ | 141 | → | 9 |
| 142 | ~ | 149 | → | 10 |
| 150 | ~ | 157 | → | 11 |
| 158 | ~ | 171 | → | 12 |
| 172 | ~ | 187 | → | 13 |
| 188 | ~ | 197 | → | 14 |
| 198 | ~ | 205 | → | 15 |
| 206 | ~ | 213 | → | 16 |
| 214 | ~ | 221 | → | 17 |
| 222 | ~ | 227 | → | 18 |
| 228 | ~ | 232 | → | 19 |
| 233 | ~ | 237 | → | 20 |
| 238 | ~ | 243 | → | 21 |
| 244 | ~ | 248 | → | 22 |
| 249 | ~ | 253 | → | 23 |
| 254 | ~ | 255 | → | 24 |

→ *data of output 1 (5 bits)*

*FIG.8*

*data of input 2*

*data of input 1*

| | 0 | 1 | 2 | 3 | 29 | 30 | 31 |
|---|---|---|---|---|---|---|---|
| 0 | 0 | 0 | 0 | 0 | 0 | 0 | 0 |
| | · | · | · | · | · | · | · |
| 31 | 31 | 19 | 11 | 9 | 0 | 0 | 0 |
| | · | · | · | · | · | · | · |
| 63 | 63 | 51 | 47 | 43 | 21 | 20 | 19 |
| | · | · | · | · | · | · | · |
| 95 | 95 | 87 | 75 | 69 | 33 | 32 | 31 |
| | · | · | · | · | · | · | · |
| 111 | 111 | 106 | 101 | 99 | 45 | 44 | 43 |
| 112 | 120 | 112 | 102 | 100 | 46 | 45 | 44 |
| | · | · | · | · | · | · | · |
| 127 | 137 | 127 | 115 | 109 | 57 | 56 | 55 |
| | · | · | · | · | · | · | · |
| 135 | 145 | 135 | 129 | 125 | 69 | 68 | 67 |
| 136 | 146 | 145 | 136 | 126 | 70 | 69 | 68 |
| | · | · | · | · | · | · | · |
| 159 | 183 | 171 | 159 | 152 | 85 | 84 | 83 |
| 160 | 184 | 172 | 163 | 153 | 86 | 85 | 84 |
| | · | · | · | · | · | · | · |
| 191 | 227 | 217 | 207 | 199 | 121 | 120 | 119 |
| 192 | 228 | 218 | 208 | 200 | 122 | 121 | 120 |
| 193 | 229 | 219 | 209 | 201 | 123 | 122 | 121 |
| | · | · | · | · | · | · | · |
| | · | · | · | · | · | · | · |
| 223 | 253 | 249 | 245 | 241 | 161 | 160 | 159 |
| | · | · | · | · | · | · | · |
| 246 | 255 | 255 | 255 | 255 | 213 | 212 | 211 |
| | · | · | · | · | · | · | · |
| 255 | 255 | 255 | 255 | 255 | 255 | 255 | 255 |

*FIG. 9* data of input 2 data of input 1

| | 0 | 1 | 2 | 3 | 4 | 5 | 6 | 7 | 8 | 9 | 10 | 11 |
|---|---|---|---|---|---|---|---|---|---|---|---|---|
| 0 | 0 | 0 | 0 | 0 | 0 | 0 | 0 | 0 | 0 | 0 | 0 | 0 |
| 1 | 1 | 1 | 1 | 0 | 0 | 0 | 0 | 0 | 0 | 0 | 0 | 0 |
| | • | • | • | • | • | • | • | • | • | • | • | • |
| 7 | 7 | 4 | 4 | 3 | 3 | 3 | 2 | 2 | 2 | 2 | 2 | 2 |
| | • | • | • | • | • | • | • | • | • | • | • | • |
| 15 | 16 | 14 | 11 | 10 | 10 | 9 | 8 | 8 | 7 | 7 | 6 | 6 |
| | • | • | • | • | • | • | • | • | • | • | • | • |
| 23 | 30 | 25 | 21 | 18 | 17 | 16 | 14 | 13 | 12 | 10 | 10 | 9 |
| | • | • | • | • | • | • | • | • | • | • | • | • |
| 31 | 39 | 35 | 31 | 27 | 24 | 21 | 19 | 18 | 16 | 14 | 12 | 10 |
| | • | • | • | • | • | • | • | • | • | • | • | • |
| 39 | 49 | 45 | 42 | 40 | 36 | 32 | 28 | 25 | 21 | 18 | 14 | 12 |
| | • | • | • | • | • | • | • | • | • | • | • | • |
| 47 | 58 | 54 | 52 | 50 | 48 | 46 | 42 | 38 | 32 | 27 | 22 | 18 |
| | • | • | • | • | • | • | • | • | • | • | • | • |
| 55 | 63 | 63 | 63 | 63 | 63 | 62 | 59 | 57 | 48 | 42 | 36 | 32 |
| | • | • | • | • | • | • | • | • | • | • | • | • |
| | 63 | 63 | 63 | 63 | 63 | 63 | 63 | 62 | 62 | 62 | 62 | 59 |
| 63 | 63 | 63 | 63 | 63 | 63 | 63 | 63 | 63 | 63 | 63 | 63 | 63 |

FIG. 10 data of input 2 data of input 1

| | 0 | 1 | 2 | 3 | 4 | 5 | 6 |
|---|---|---|---|---|---|---|---|
| 0 | 0 | 0 | 0 | 0 | 0 | 0 | 0 |
| 1 | 1 | 1 | 0 | 0 | 0 | 0 | 0 |
| | • | • | • | • | • | • | • |
| 7 | 6 | 4 | 3 | 2 | 2 | 2 | 2 |
| | • | • | • | • | • | • | • |
| 15 | 15 | 11 | 9 | 9 | 8 | 7 | 6 |
| | • | • | • | • | • | • | • |
| 23 | 28 | 19 | 16 | 14 | 12 | 11 | 9 |
| | • | • | • | • | • | • | • |
| 31 | 37 | 30 | 22 | 19 | 16 | 13 | 11 |
| | • | • | • | • | • | • | • |
| 39 | 48 | 41 | 34 | 27 | 22 | 17 | 13 |
| | • | • | • | • | • | • | • |
| 47 | 57 | 51 | 47 | 41 | 33 | 26 | 19 |
| | • | • | • | • | • | • | • |
| 55 | 63 | 63 | 60 | 56 | 49 | 41 | 33 |
| | • | • | • | • | • | • | • |
| | 63 | 63 | 63 | 62 | 62 | 62 | 61 |
| 63 | 63 | 63 | 63 | 63 | 63 | 63 | 63 |

*FIG.11*

*data of input 2*

*data of input 1*

| | 0 | 1 | 2 | 3 | | 22 | 23 | 24 |
|---|---|---|---|---|---|---|---|---|
| 0 | 0 | 0 | 0 | 0 | | 0 | 0 | 0 |
| | · | · | · | · | | · | · | · |
| 31 | 35 | 33 | 31 | 27 | | 15 | 15 | 15 |
| | · | · | · | · | | · | · | · |
| 63 | 75 | 73 | 71 | 67 | | 47 | 47 | 47 |
| | · | · | · | · | | · | · | · |
| 95 | 111 | 109 | 107 | 105 | | 67 | 65 | 63 |
| | · | · | · | · | | · | · | · |
| 111 | 129 | 127 | 125 | 123 | | 83 | 81 | 79 |
| 112 | 130 | 128 | 126 | 124 | | 84 | 82 | 80 |
| | · | · | · | · | | · | · | · |
| 127 | 147 | 145 | 143 | 141 | | 99 | 97 | 95 |
| | · | · | · | · | | · | · | · |
| 135 | 156 | 154 | 152 | 150 | | 109 | 107 | 105 |
| 136 | 157 | 155 | 153 | 151 | | 110 | 108 | 106 |
| | · | · | · | · | | · | · | · |
| 159 | 183 | 181 | 179 | 177 | | 139 | 137 | 135 |
| 160 | 184 | 182 | 180 | 178 | | 140 | 138 | 136 |
| | · | · | · | · | | · | · | · |
| 191 | 219 | 217 | 215 | 213 | | 182 | 180 | 179 |
| 192 | 220 | 218 | 216 | 214 | | 183 | 181 | 180 |
| 193 | 221 | 218 | 217 | 215 | | 184 | 182 | 181 |
| | · | · | · | · | | · | · | · |
| | · | · | · | · | | · | · | · |
| 223 | 243 | 237 | 239 | 239 | | 217 | 216 | 215 |
| | · | · | · | · | | · | · | · |
| 246 | 252 | 250 | 251 | 251 | | 244 | 244 | 244 |
| | · | · | · | · | | · | · | · |
| 255 | 255 | 255 | 255 | 255 | | 255 | 255 | 255 |

FIG.13A in the case wher an image of a ball provides 21 gray levels and an image of a background provides 36 gray levels

| | overshooting | | | |
|---|---|---|---|---|
| | in the case of no overshooting driving | in the case of using overshooting driving | | |
| | | in the case of reduction of number of bits | | |
| | | no reduction of number of bits | 4 bits | 3 bits |
| image quality | many trails | less trails | less trails | highlighted edge line of ball |
| maximum error of overshooting gray scales | — | 0 | 1 | 4 |
| rank of image quality | × | ○ | ○ | × |

FIG.13B in the case wher an image of a ball provides 39 gray levels and an image of a background provides 30 gray scales

| | overshooting | | | |
|---|---|---|---|---|
| | in the case of no overshooting driving | in the case of using overshooting driving | | |
| | | in the case of reduction of number of bits | | |
| | | no reduction of number of bits | 4 bits | 3 bits |
| image quality | many trails | less trails | less trails | highlighted edge line of ball |
| maximum error of overshooting gray scales | — | 0 | 2 | 5 |
| rank of image quality | × | ○ | ○ | × |

LIQUID CRYSTAL DISPLAY DEVICE

BACKGROUND OF THE INVENTION

1. Field of the Invention

The present invention relates to a liquid crystal display device whose capacity of a frame memory required for driving a liquid crystal panel in an overshooting manner can be reduced.

The present application claims priorities of Japanese Patent Application Nos.2001-192076 filed on Jun. 25, 2001 and 2002-146165 filed on May 21, 2002, which are hereby incorporated by reference.

2. Description of the Related Art

Transmittance of light of a liquid crystal substance making up a liquid crystal cell is changed by a change in an alignment of a molecule occurring when an electric field is applied. An image display can be achieved by using a liquid crystal panel in which many tiny liquid crystal cells made up of liquid crystal substances are arranged on a transparent substrate and a signal voltage can be individually applied to each of the liquid crystal cells and by using a light source mounted on a rear of the liquid crystal panel and by controlling transmittance of light applied from the light source for every liquid crystal cell.

However, in the liquid crystal display device, the change in the molecular alignment occurring at a time when an electric field is applied to the liquid crystal substance entails time delays and therefore an accumulating effect in its light-emitting responsivity is produced. As a result, in the case of displaying moving pictures, there is a problem in that delays in the movement of the image cause a person to be hard to see pictures.

An effort to improve display performance of a moving picture is being made by employing an overshooting driving method in which a large signal voltage is applied for a short time while a liquid crystal cell is driven which causes a change in a molecular alignment of a liquid crystal substance to be accelerated.

FIG. 14 is a schematic block diagram showing an example of a configuration of a conventional liquid crystal display device to be driven in an overshooting manner. The conventional liquid crystal display device, as shown in FIG. 14, chiefly includes a controller 101, a frame memory 102, a look-up table 103, and a liquid crystal display (LCD) 104. Moreover, in the liquid crystal display device, in ordinary cases, liquid crystal cells each corresponding to each of three primary colors including a red (R) color, green (G) color, and blue (B) color are provided and RGB data is fed to each of the liquid crystal cells to display a color image and hereinafter operations in the case of a single color are described to simplify the explanation.

An input 1 for an image signal made up of, for example, bits of digital data (gray-scale value) is fed from an outside device to a controller 101 and is sequentially transferred to a frame memory 102 where it is held for one frame period and then is output. The controller 101 feeds an output from the frame memory 102 as an input 2 to the look-up table 103.

On the other hand, the input 1 is directly fed to the look-up table 103. The look-up table 103, according to a gray-scale value of the input 1 and the input 2 generates an output 2 required for an overshooting driving and feeds it to the LCD 104.

In the LCD 104, a pixel electrode is mounted at every point of intersections of a plurality of scanning lines arranged in a horizontal (row) direction and a plurality of data lines in a vertical (column) direction. It has a scanning line driving circuit used to drive the scanning line (not shown) and a data line driving circuit used to drive the data line (not shown). A supply of a scanning signal from the scanning line driving circuit according to synchronizing data fed from the controller 101 causes the scanning line on each row to be sequentially driven and a supply of a data signal by the data line driving circuit to each data line according to synchronizing data fed from the controller 101 and according to a gray-scale value of the output 2 fed from the look-up table 103 causes the data line on each column to be sequentially driven. An image display is achieved by changing transmittance of light according to a voltage of a data signal fed from a corresponding data line occurring when a gate of a TFT (Thin Film Transistor) being connected between each of the pixel electrodes and each of corresponding data lines is turned ON by a scanning signal from the scanning line.

At this point, the look-up table 103, in order to perform an overshooting driving, generates the output 2 being an overshooting gray-scale value, for one frame period following a change of a gray-scale value of the input 1 according to a gray-scale value of the input 1 and input 2. That is, the look-up table 103 is set a value, in advance, so that, when a gray-scale value of an input 1 is equal to a gray-scale of an input 2 the gray-scale value is output as an output 2, however, when a gray-scale value of the input 2 is smaller than a gray-scale of the input 1, an output 2 having a gray-scale value being larger than an gray-scale value of an input 2 is output as an overshooting gray-scale value and, when a gray-scale value of an input 2 is larger than a gray-scale value of an input 1, an output 2 having a gray-scale value being smaller than a gray-scale value of the input 2 is output as an overshooting gray-scale value.

Functions of the overshooting driving are described by referring to FIG. 15 below. When there is no change in a gray-scale value in the input 1 during a frame Fl, since no change occurs yet in the input 2, signal levels of the input 1 and input 2 are same in the look-up table 103 and, therefore, a gray-scale value of the input 1 =input 2 =D1 is output as an output 2 from the look-up table 103. During a subsequent frame F2, when a gray-scale value of the input 1 is changed from Dl to D2, since a gray-scale value Dl of the input 2 remains unchanged, the input 1 to the look-up table 103 >the input 2 to the look-up table 103 and an overshooting value DO being stored in advance is output corresponding to a gray-scale value D1 of the input 1 and a gray-scale value D2 of the input 2 is output as an output 2 from the look-up table 103, which causes the overshooting driving to be performed.

In a subsequent frame F3, since a gray-scale value of the input 2 becomes D2, a gray-scale value of an input 1 =input 2 =D2 is output as an output 2 from the look,-up table 103. A data signal for a corresponding pixel electrode is applied to the LCD 104 according to a gray-scale value fed from the look-up table 103 and, at this point, luminance of the LCD 104 is changed in such a manner that its luminance L1 corresponding to a gray-scale value D1 during the frame F1 undergoes a transient change based on an overshooting gray-scale value D0 during the frame F2 and becomes a luminance L2 corresponding to a gray-scale value D2 during the frame F3.

Now, if it is presumed that, in FIG. 14, there is no look-up table 103 and the LCD 104 is to be directly driven by the input 1, as indicated by a broken line in FIG. 15, a gray-scale value of the output 2 to be fed to the LCD 104 immediately becomes "D2" during the frame F2, however, a rise of the luminance of the LCD 104 from its luminance L1 is gentle due to delays in operations of the liquid crystal cell as indicated by another broken line in FIG. 15 and very long delays develop in an image display.

In contrast, when the overshooting driving is employed, as indicated by a solid line in FIG. 15, the rise of the luminance of the LCD 104 from its luminance L1 corresponding to the gray-scale value D1 becomes sharp and then the luminance corresponding to the gray-scale value D2 becomes "L2", thus improving delays in the image display.

Moreover, if an input gray-scale value D2 is larger than an input gray-scale value D1, an overshooting gray-scale value D0 becomes larger than an input gray-scale value D2. However, it the input gray-scale value D2 becomes smaller than an input gray-scale value D1, an overshooting gray-scale value D0 becomes smaller than the input gray-scale value D2. The larger becomes a difference between the input gray-scale value D2 and the input gray-scale value D1, the larger becomes an amount of a change in the overshooting gray-scale value D0 relative to the input gray-scale value D2.

Thus, in the liquid crystal display device, by performing overshooting driving using the look-up table to improve delays in the image display, it is made possible to improve visibility in image display of moving pictures.

However, the conventional liquid crystal display shown in FIG. 14 has a problem in that, since data of the input 1 fed from an outside device, as it is, is directly stored in the frame memory 102, it is necessary that memory capacity of the frame memory 102 should be large.

SUMMARY OF THE INVENTION

In view of the above, it is an object of the present invention to provide a liquid crystal display device having a look-up table to perform overshooting driving which is capable of reducing memory capacity of a frame memory to be used for delaying input data.

According to a first aspect of the present invention, there is provided a liquid crystal display device for displaying an image using a liquid crystal panel including:

a first table section to produce output gray-scale data obtained by reducing a number of bits of first input gray-scale data;

a frame memory section to produce second input gray-scale data obtained by delaying the output gray-scale data fed by the first table section by one frame image display period in the liquid crystal panel;

a second table section to produce an overshooting gray-scale output being in advance stored according to a relation in size between the first input gray-scale data and the second input gray-scale data; and wherein image display in the liquid crystal panel is achieved by using the overshooting gray-scale output.

In the foregoing, a preferable mode is one wherein the first table section reduces a number of bits of the output gray-scale data by performing data conversion so that, when a gray-scale value of the first input gray-scale data is small, the output gray-scale data is produced at rough intervals and so that, whenever a gray-scale value of the first input gray-scale data is large, the output gray-scale data is produced at shorter and finer intervals.

Also, a preferable mode is one wherein the first input gray-scale data is made up of 8 bits and the output gray-scale data is made up of 5 bits.

Also, a preferable mode is one wherein the first input gray-scale data is made up of 6 bits and output gray-scale data is made up of 4 bits.

Also, a preferable mode is one wherein the first input gray-scale data is made up of 6 bits and the output gray-scale data is made up of 3 bits.

Also, a preferable mode is one wherein each of red color data, green color data, and blue color data making up respectively the first input gray scale data is made up of 8 bits while each of red color data and blue color data making up the output gray-scale data is made up of 5 bits and green color data making up the output gray-scale data is made up of 6 bits.

Also, a preferable mode is one wherein the second table section produces a gray-scale value, obtained by performing data conversion to convert a number of the bits, corresponding to a gray-scale value being larger than, equal to, or smaller than a gray-scale value of the first input gray-scale data, depending on whether a gray-scale value of the first input gray-scale data is larger than, equal to, or smaller than a gray-scale value of the second input gray-scale data corresponding to the first input gray-scale data when data conversion to reduce a number of bits is not performed.

Also, a preferable mode is one wherein the liquid crystal panel is of Twisted Nematic (TN) type.

Also, a preferable mode is one wherein the liquid crystal panel is of In-Plane Switching (IPS) type.

Also, a preferable mode is one wherein image display in the liquid crystal panel is performed by a dot reversing method.

Also, a preferable mode is one wherein image display in the liquid crystal panel is performed by a line reversing method.

Furthermore, a preferable mode is one wherein image display in the liquid crystal panel is performed by a frame reversing method.

With the above configurations, in order to apply an overshooting driving method, when input data is delayed in a frame memory by one frame period and is then input to a look-up table to determine an overshooting gray-scale value, by mounting a date converting table on an input side to reduce a number of bits of the input data and then holding it in a frame memory, it is made possible to greatly reduce a capacity of a frame memory and to minimize a size of the frame memory and to lower costs.

BRIEF DESCRIPTION OF THE DRAWINGS

The above and other objects, advantages, and features of the present invention will be more apparent from the following description taken in conjunction with the accompanying drawings in which:

FIG. 5 is a diagram showing an example of a content of a data converting table employed in an IPS (In-Plane Switching)-type liquid crystal panel according to the embodiment of the present invention;

FIG. 8 is a diagram showing one example of a content of a look-up table employed in the TN-type liquid crystal panel according to the embodiment of the present invention;

FIG. 9 is a diagram showing another example of a content of a look-up table employed in the TN type liquid crystal panel according to the embodiment of the present invention;

FIG. 10 is a diagram showing still another example of a content of a look-up table employed in the TN-type liquid crystal panel according to the embodiment of the present invention;

FIG. 11 is a diagram showing an example of a content of a look-up table employed in the IPS-type liquid crystal panel according to the embodiment of the present invention;

FIGS. 13A and 13B are diagrams showing an example of confirmation of effects of overshooting driving by a visual check;

DETAILED DESCRIPTION OF THE PREFERRED EMBODIMENTS

Best modes of carrying out the present invention will be described in further detail using various embodiments with reference to the accompanying drawings.

Embodiment

Figure 1:
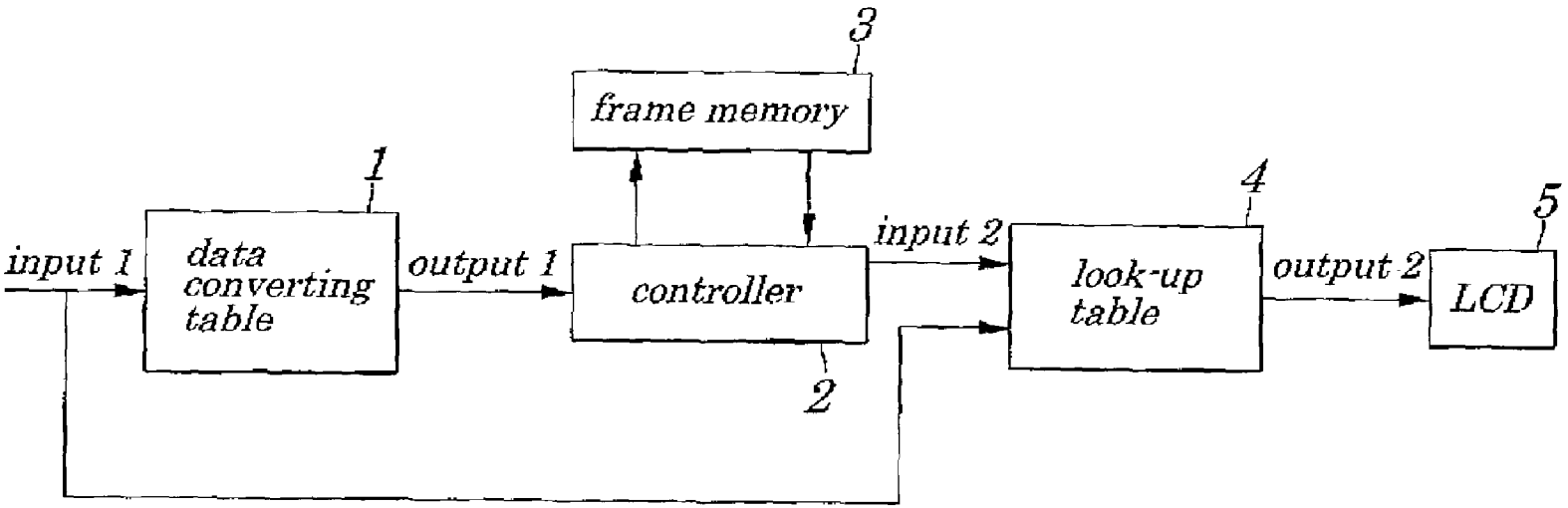
FIG. 1 is a block diagram showing configurations of a liquid crystal display device according to an embodiment of the present invention.
Figure 2:
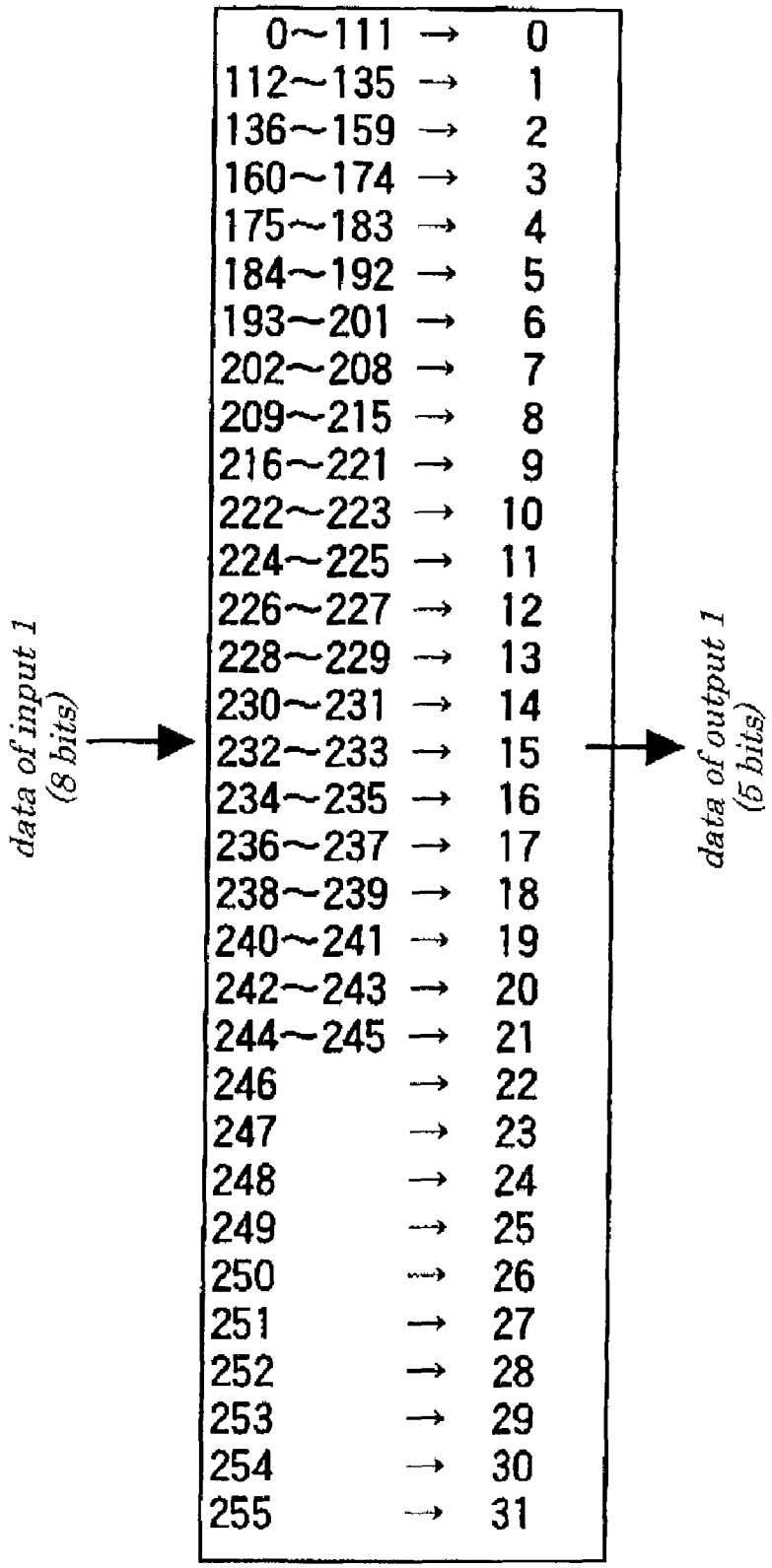
FIG. 2 is a diagram showing one example of a content of a data converting table employed in a TN (Twisted Nematic)-type liquid crystal panel according to the embodiment of the present invention.
Figure 3:
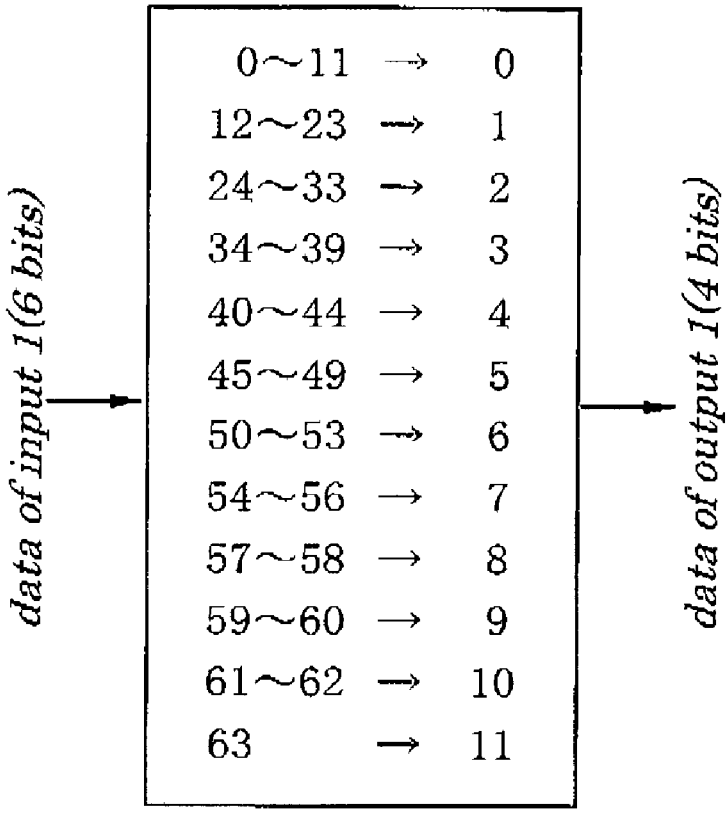
FIG. 3 is a diagram showing another example of a content of a data converting table employed in a TN-type liquid crystal panel according to the embodiment of the present invention.
Figure 4:
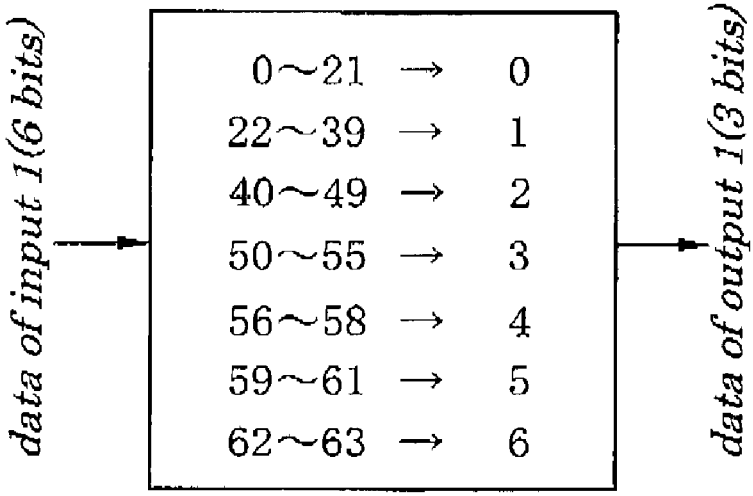
FIG. 4 is a diagram showing still another example of a content of a data converting table employed in a TN-type liquid crystal panel according to the embodiment of the present invention.
Figure 6:
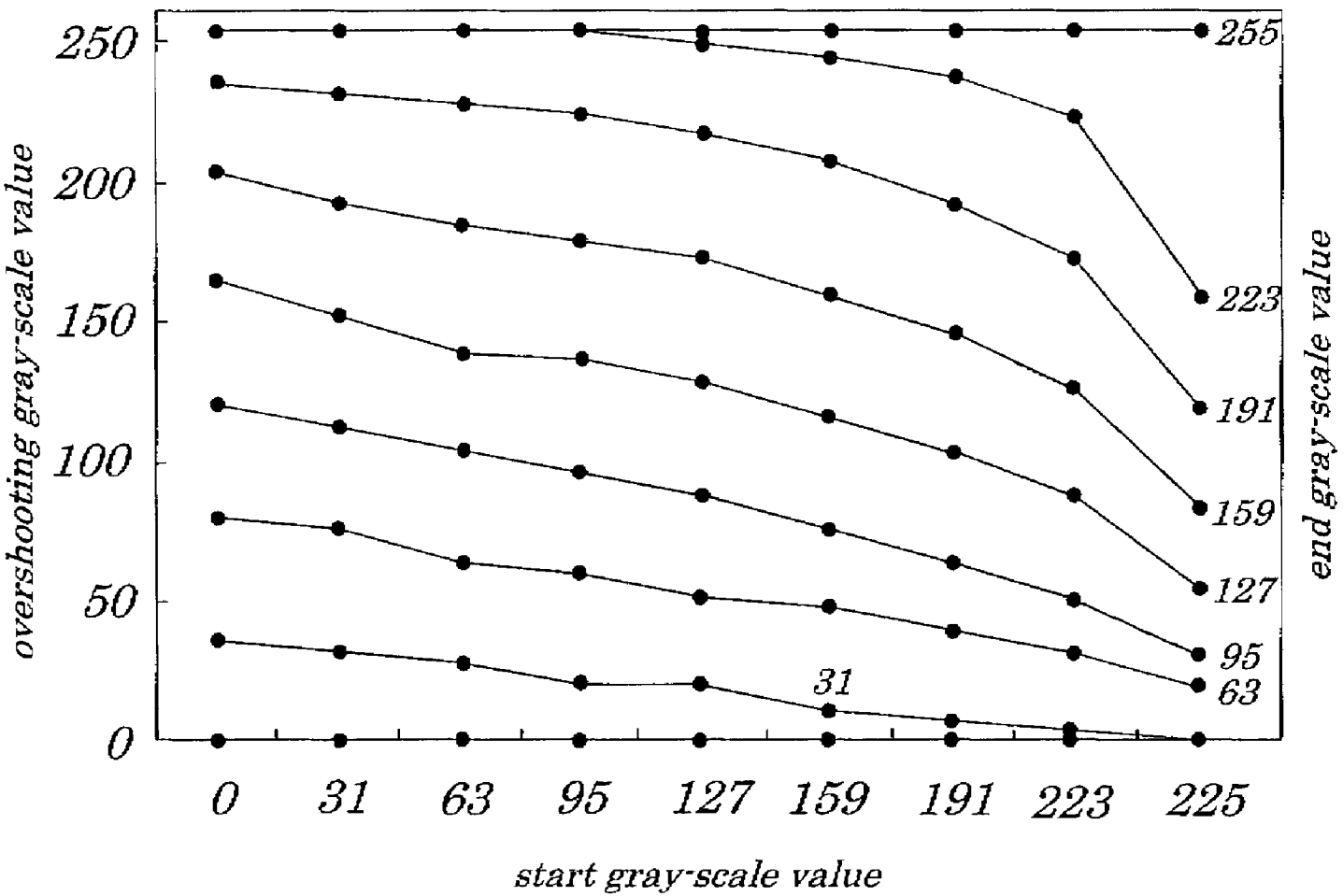
FIG. 6 is a graph for explaining an operation of overshooting driving in the TN-type liquid crystal panel according to the embodiment of the present invention.
Figure 7:
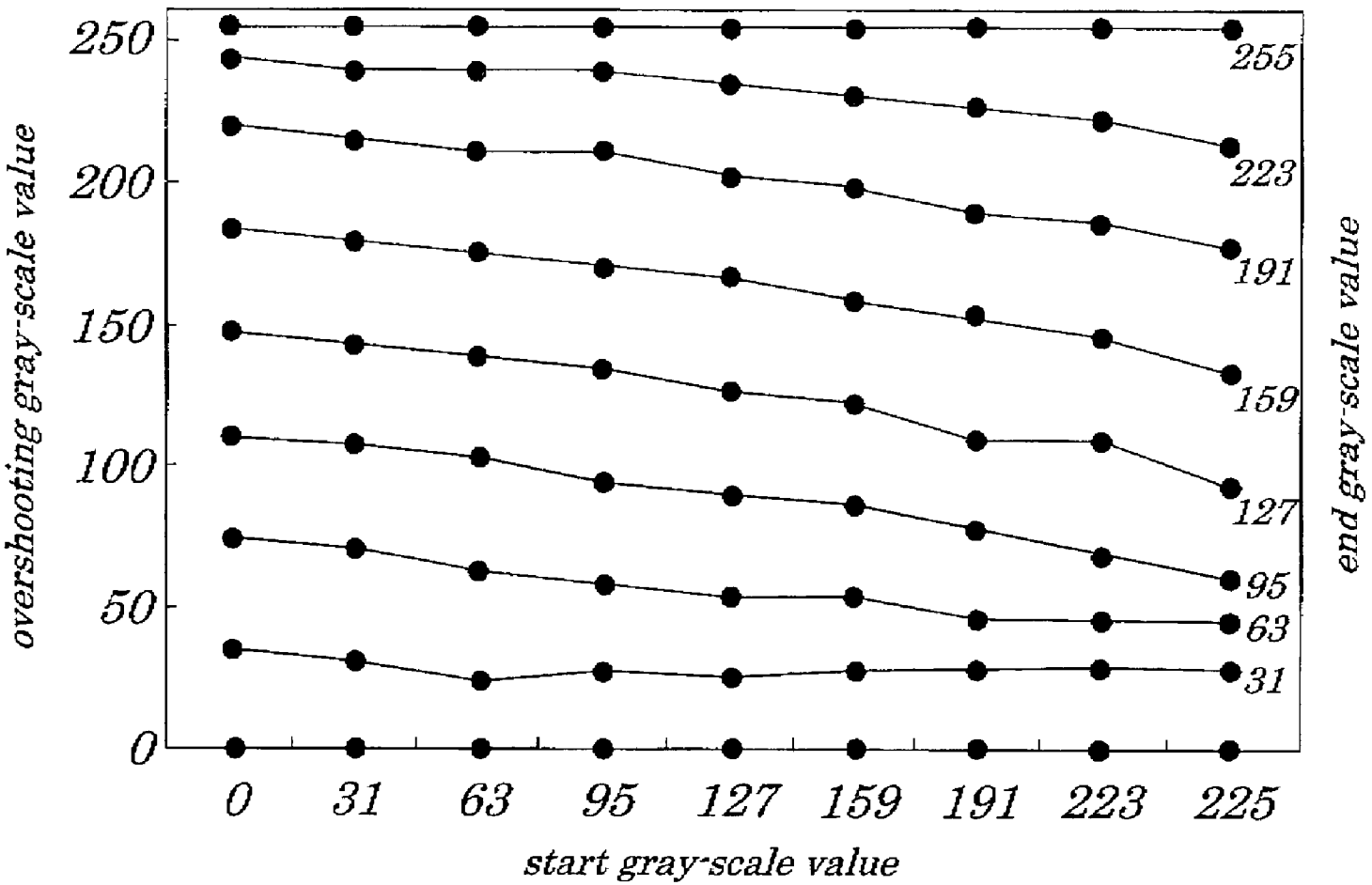
FIG. 7 is a graph for explaining an operation of overshooting driving in the IPS-type liquid crystal panel according to the embodiment of the present invention.
Figure 12:
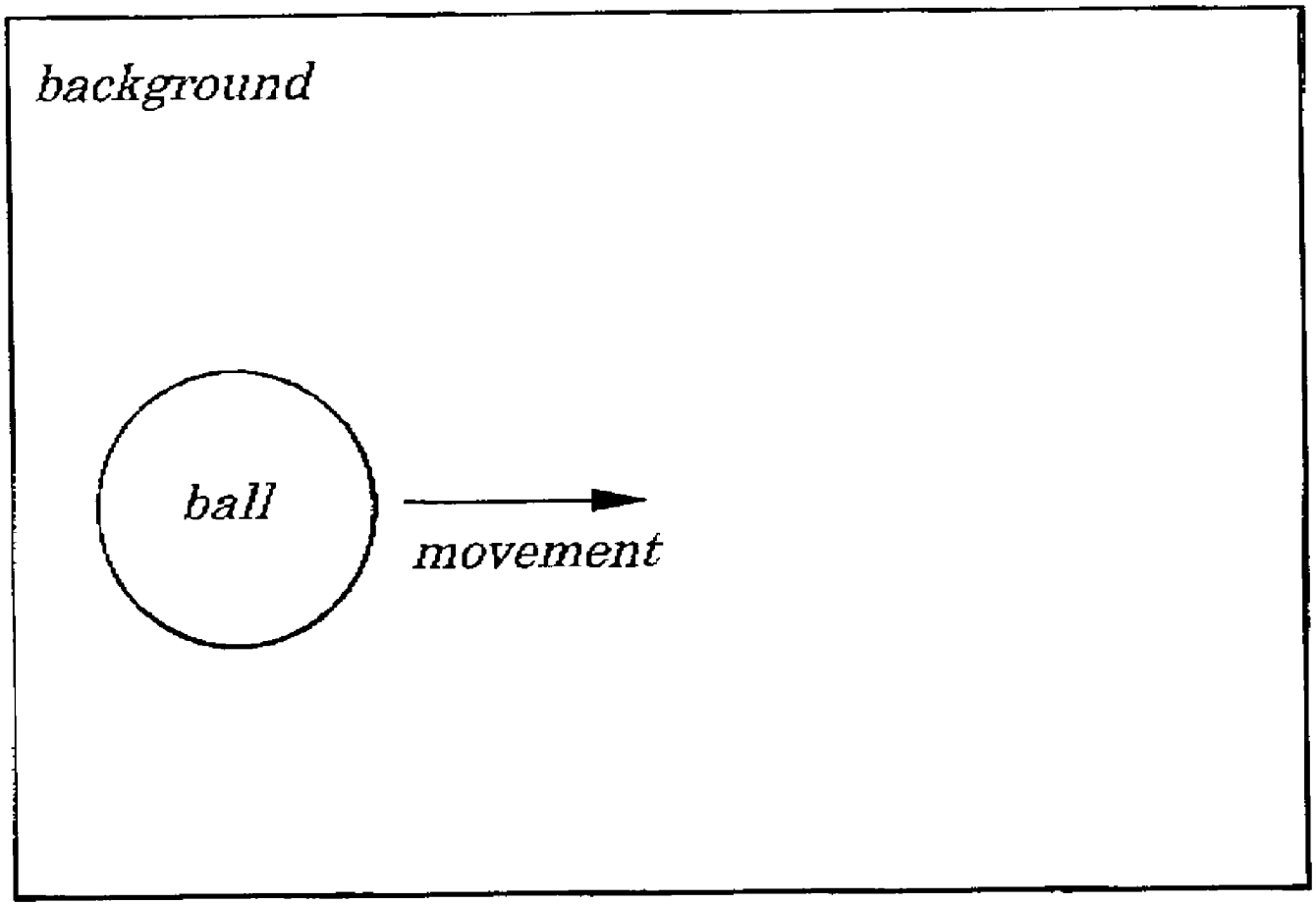
FIG. 12 is a diagram showing an example of a moving image used to confirm effects of overshooting driving according to the embodiment of the present invention.

FIG. 1 is a block diagram showing configurations of a liquid crystal display device according to an embodiment of the present invention. FIG. 2 is a diagram showing one example of a content of a data converting table employed in a TN-type liquid crystal panel according to the embodiment. FIG. 3 is a diagram showing another example of a content of a data converting table employed in a TN-type liquid crystal panel according to the embodiment. FIG. 4 is a diagram showing still another example of a content of a data converting table employed in a TN-type liquid crystal panel according to the embodiment. FIG. 5 is a diagram showing an example of a content of a data converting table employed in an IPS-type liquid crystal panel according to the embodiment. FIG. 6 is a graph for explaining an example of an operation of overshooting driving in the TN-type liquid crystal panel according to the embodiment. FIG. 7 is a graph for explaining an operation of overshooting driving in the IPS-type liquid crystal panel according to the embodiment. FIG. 8 is a diagram showing one example of a content of a look-up table employed in the TN-type liquid crystal panel according to the embodiment. FIG. 9 is a diagram showing another example of a content of a look-up table employed in the TN-type liquid crystal panel according to the embodiment. FIG. 10 is a diagram showing still another example of a content of a look-up table employed in the TN-type liquid crystal panel according to the embodiment. FIG. 11 is a diagram showing an example of a look-up table employed in the IPS-type liquid crystal panel according to the embodiment. FIG. 12 is a diagram showing an example of a moving image used to confirm effects of overshooting driving according to the embodiment. FIGS. 13A and 13B are diagrams showing an example of confirmation of effects of overshooting driving by a visual check.

Moreover, in the liquid crystal display device of the embodiment, as in the case of the conventional example in FIG. 14, display of a color image is performed by performing same processing for every color using RGB (Red, Green, and Blue) data fed from an outside device, however, to simplify descriptions provided below, a case of single color display will be explained.

The liquid crystal display device of the embodiment, as shown in FIG. 1, chiefly includes a data converting table 1, a controller 2, a frame memory 3, a look-up table 4, and an LCD 5. Of them, the LCD 5 has same configurations as in the case of the conventional LCD 104 shown in FIG. 14. The data converting table 1 converts an input 1 of an image signal fed from an outside device so that its number of bits is reduced and then outputs the converted input 1 as an output 1. The controller 2, after having delayed the output 1 by one frame period in the frame memory 3, feeds the delayed output 1 to the look-up table 4 as an input 2. The frame memory 3 sequentially holds input data for one frame period and then outputs it. The look-up table 4, by using the input 1 from the outside device and the input 2 from the controller 2, generates an output 2 used to perform overshooting driving and feeds it to the LCD 5.

Operations of the liquid crystal display device of the example will be described by referring to FIG. 1 to FIGS. 13A and 13B. The data converting table 1 changes an data interval of the input 1 being an image signal made up of digital data (gray scale value) fed from an outside device to convert its number of bits from, for example, 8 bits to, for example, 5 bits and outputs the converted input, as an output 1 The controller 2, by inputting the output 1 to the frame memory 3 and then by outputting it after having held for one frame period in the frame memory 3, delays the output 1 by one frame period and feeds it as an input 2 to the look-up table 4. Since the look-up table 4 directly receives the input 1 simultaneously when receiving the input 2 it generates an output 2 used to perform overshooting driving to be determined by each of the input 1 and input 2 and feeds it to the LCD 5.

Figure 14:
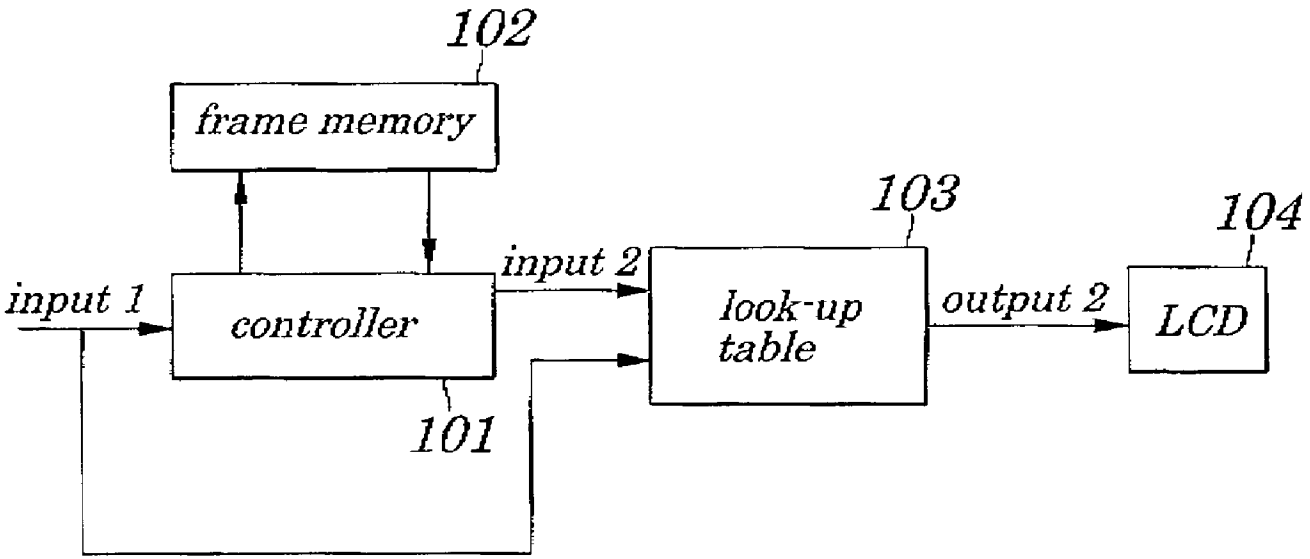
FIG.14(PRIOR ART)
FIG. 14 is a schematic diagram showing an example of configurations of a liquid crystal display device performing a conventional overshooting driving.
Figure 15:
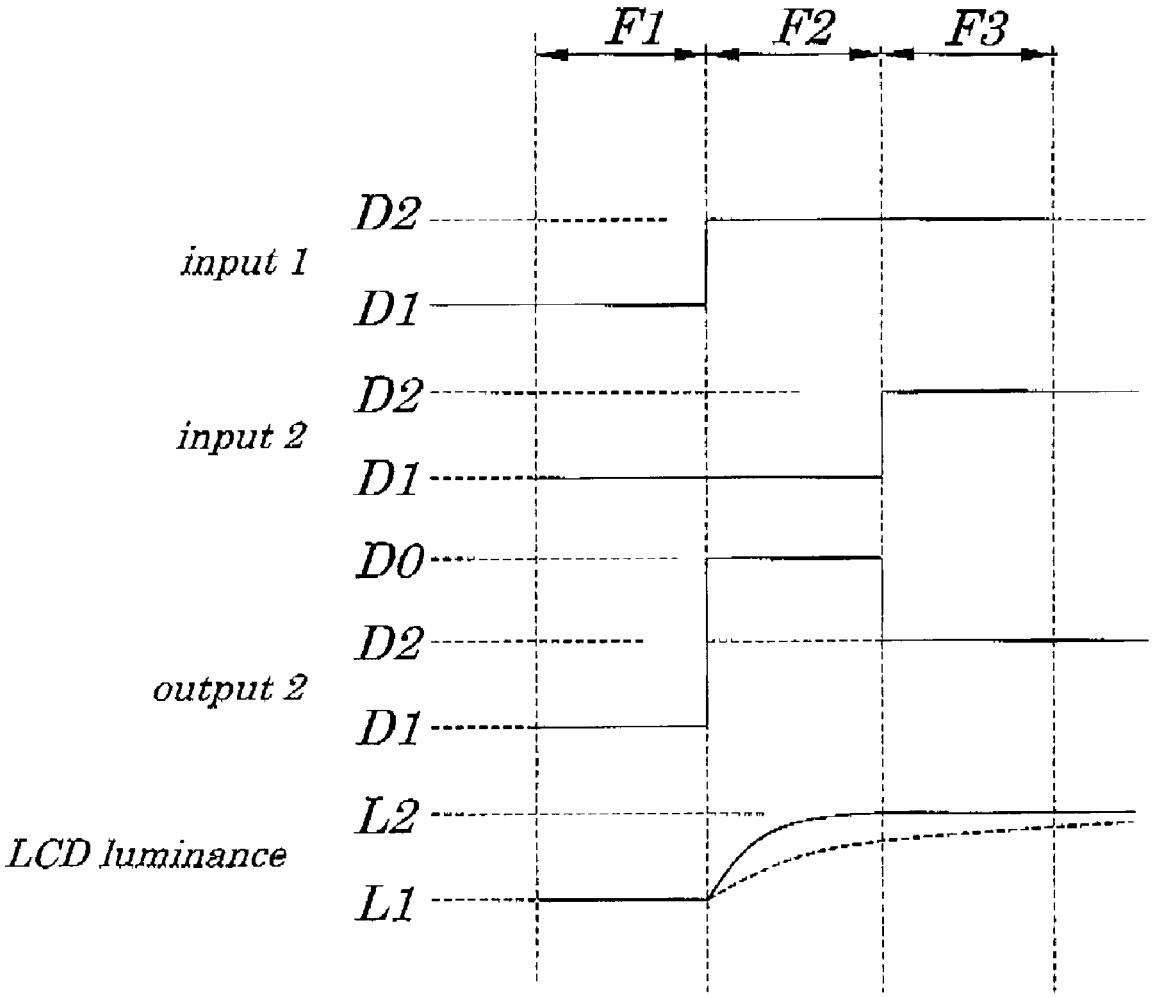
FIG.15(PRIOR ART)
FIG. 15 is a diagram for explaining a function of the conventional overshooting driving.

In the LCD 5, as in the conventional example shown in FIG. 14, a scanning line driving circuit (not shown) feeds a scanning signal to each scanning line according to synchronous data fed from the controller 2 and a data line driving circuit (not shown) feeds a data signal to each data line according to synchronous data fed from the controller 2 and changes a signal of the data line on each column according to data on a gray-scale value fed through the output 2 from the controller 2, which then changes transmittance of light in each of the pixel electrodes, thus displaying an image.

In this case, the data conversion by the data converting table 1 is performed in a way as shown in FIG. 2 or FIG. 5. FIG. 2 shows the data conversion in the case of the TN-type liquid crystal panel. In the data converting table shown in FIG. 2, 8 bits of gray-scale data for the input 1 are converted to 5 bits of gray-scale data of the output 1. At this point, data of the output 1 is so set that, if a gray-scale value of data of the input 1 is near to "0" (black), an interval of data of the output 1 becomes large and, as a gray-scale value of data of the input 1 becomes nearer to 255 (white), an interval of data of the output 1 becomes shortened.

FIG. 3 shows an example of a content of a data converting table 1 which is used to convert gray-scale data of the input 1 made up of 6 bits to gray-scale data of the output 1 made up of 4 bits in the case of the TN-type liquid crystal panel and, as in the case shown in FIG. 2, the larger the gray-scale value of data of the input 1, the smaller the intervals between data of the output 1. Moreover, FIG. 4 shows an example of a content of a data converting table 1 which is used to convert gray-scale data of the input 1 made up of 6 bits to gray-scale data of the output 1 made up of 3 bits in the case of the TN-type liquid crystal panel and the larger the gray-scale value of data of the input 1, the smaller the intervals between data of the output 1.

FIG. 5 shows an example in which gray-scale data of the input 1 being of 8 bits is converted to gray-scale data of the output 1 being of 5 bits in the case of the IPS (In-Plane Switching)-type liquid crystal panel. Configurations of the data converting table 1 are similar to those in the case of the TN-type liquid crystal panel shown in FIG. 2 to FIG. 4, however, due to a difference in a transmittance of the liquid crystal panel, its content is somewhat different from the configurations shown in FIG. 2 to FIG. 4.

Moreover, in the case of the IPS-type liquid crystal panel, the data converting table 1 used to convert gray-scale data of the input 1 being of 6 bits to gray-scale data of the output 1 being of 4 bits or the data converting table 1 used to convert gray-scale data of the input 1 being or 6 bits to gray-scale data of the output 1 being of 3 bits can be created in the same manner as described above.

The reason why, on a side where a gray-scale value of data of the input 1 is near to 0 (zero), an interval between data of the output 1 can be made large in the data conversion using the data converting table 1 shown in FIG. 2 to FIG. 5 is that an overshooting gray-scale value on the side where the gray-scale value of data of the input 1 is near to 0 (zero) is determined almost by a gray-scale value of the input 1 in a frame immediately before a frame where the overshooting driving is performed, that is, a gray-scale value in a present frame.

FIG. 6 is a graph showing data for the overshooting driving in the case of the TN-type liquid crystal panel. In FIG. 6, a gray-scale value of a frame immediately before a frame where overshooting driving is performed, that is, a gray-scale value of input data in the frame memory 3 is plotted as abscissa and a gray-scale value in a frame where overshooting driving is performed is plotted as ordinate and each graph shows a gray-scale value of a frame immediately after a frame in which overshooting driving has been performed. Moreover, in FIG. 6, a gray-scale value in a frame immediately before the overshooting driving is performed is referred to as a "start gray-scale value" and a gray-scale value immediately after the overshooting driving has been performed is referred to as an "end gray-scale value".

As shown in FIG. 6, if a start gray-scale value is near to 0 (zero) (almost reaching a black color), for example, in a range of 0 to 111 gray-scale levels, since a tilt of a graph for an end gray-scale value is gentle and almost horizontal, the end gray-scale value is obtained, it is possible to determine an overshooting value. Therefore, in the frame memory 3, since exact storing of the start gray-scale value is not required, when only one value (for example, a value "0" of the output 1 in the table in FIG. 2) corresponding to an above range is stored, practically, operations are made possible without any problem.

On the other hand, if the start gray-scale value is near to 255 (almost reaching to a white color), since the tilt of the graph is large, unless not only the end gray-scale value but also the start gray-scale value are exactly stored, it is impossible to determine the overshooting gray-scale value.

FIG. 7 is a graph showing data for the overshooting driving in the case of the IPS-type liquid crystal panel. In FIG. 7, the gray-scale values plotted as abscissa and ordinate and indications of the graph are same as those in the case of the TN-type liquid crystal panel shown in FIG. 6 and categories for the start gray-scale value and the end gray-scale value are the same as those in FIG. 6.

As shown in FIG. 7, as in the case of the TN-type liquid crystal panel, if the start gray-scale value is near to 0 (almost reaching a black color), for example, in a range of 0 to 95 gray-scale values, since a tilt of a graph for the end gray-scale value is gentle and almost horizontal, if the end gray-scale value only is obtained, it is possible to determine an overshooting gray-scale value.

On the other hand, if the start gray-scale value is near to 255 (almost reaching to a white color), since the tilt of the graph is large, unless not only the end gray-scale value but also the start gray-scale value are exactly stored, it is impossible to determine an overshooting gray-scale value.

The look-up table 4 generates an overshooting gray-scale value as an output 2 using a start gray-scale value and an end gray-scale value and feeds it to the LCD 5. In this case, when data conversion which reduces a number of bits is not performed, since an input gray-scale value is output, as it is, as an output gray-scale value in the look-up table 4 corresponding to an input gray-scale value (in some cases, there is no corresponding value) in a state where the start gray scale value is equal to the end gray-scale value, the overshooting driving is not performed, however, an overshooting gray-scale value being larger than an end gray-scale value is output for a start gray-scale value being smaller than the input gray-scale value and an overshooting qray-scale value being smaller than an end gray-scale value is output for a start gray-scale value being larger than an input gray-scale value.

FIG. 8 shows an example of a content of the look-up table 4 employed in the case of the TN-type liquid crystal panel and shows data of an actually measured value of an output 2 corresponding to data of an input 1 of 8 bits and to data of an input 2 of 5 bits.

FIG. 9 shows an example of a content of the look-up table 4 employed in the case of the TN-type liquid crystal panel and shows data of an actually measured value of an output 2 corresponding to data of an input 1 of 6 bits and to data of an input 2 of 4 bits.

FIG. 10 shows an example of a content of the look-up table 4 employed in the case of the TN-type liquid crystal panel and shows data of an actually measured value of an output 2 corresponding to data of an input 1 of 6 bits and to data of an input 2 of 3 bits.

FIG. 11 shows an example of a content of the look-up table 4 employed in the case of the IPS-type liquid crystal panel and shows data of an actually measured value of an output 2 corresponding to data of an input 1 of 8 bits and to data of an input 2 of 5 bits.

Moreover, also in the case of the IPS liquid crystal panel, as the content of the look-up table 4, data of an actually measured value of an output 2 corresponding to data of an input 1 of 6 bits and to data of an input 2 of 4 bits or data of an actually measured value of an output 2 corresponding to data of an input 1 of 6 bits and to data of an input 2 of 4 bits can be used.

FIG. 12 is a diagram showing an example of a moving image used to confirm effects of overshooting driving according to the embodiment, illustrating an image in which a ball moves in an arrow direction in a background.

FIGS. 13A and 13B show results from the confirmation of effects of the overshooting driving by a visual check, in the liquid crystal display device of the embodiment, obtained in the case of using no overshooting driving, in the case of using overshooting driving but reducing no number of bits, in the case of using overshooting driving and converting data of an input 1 being of 6 bits to data of an input being of 4 bits, and in the case of using overshooting driving and converting data of the input 1 being of 6 bits to data of an input being 3 bits in the moving image shown in FIG. 12. In this case, the effect of the overshooting driving is judged depending on whether many trails or less trails are left in a rear direction of a moving ball, that is, in the case of using no overshooting driving or insufficient overshooting driving, an image of the ball leaves many trails and, in contrast, in the case of using sufficient overshooting driving, less trails are left in the image.

The example in FIG. 13A shows a case in which the ball provides 21 gray levels and the background provides 36 gray levels and in which a change occurs in a direction where a gray scale of a screen increases in a rear direction of the ball, that is, in the case of using no overshooting driving, due to a delay in an increase in the gray scale of the background in the rear direction of the ball, a phenomenon in which an image of the ball leaves a dark trail in its rear direction is displayed remarkably, thus causing an image quality to become lower. On the other hand, in the case of using the overshooting driving and reducing no number of bits, an increase in the gray scale in the rear direction of the ball is accelerated and therefore an image of the ball leaves less trails, thus causing a maximum error in the overshooting gray scale to be 0 (zero) gray levels and thus enabling an image quality to be higher. Moreover, in the case of using overshooting driving and reducing the number of bits, that is, reducing the number of bits of data of an input from 6 to 4, a maximum error of the overshooting gray scale is one gray level in an increasing direction and therefore an image of the ball leaves less trails, thus enabling an image quality to be higher. In contrast, in the case of reducing the number of bits of data from 6 to 3, an maximum error of the overshooting gray scale is four gray levels and therefore the overshooting driving becomes excessive and, though an image of the ball leaves no trails, a rear edge line of the ball is displayed in a highlighted manner, thus causing an image quality to become low.

The example in FIG. 13B shows a case in which the ball provides 39 gray levels and the background provides 30 gray levels and in which a change occurs in a direction where a gray scale of a screen decreases in a rear direction of the ball and, in the case of using no overshooting driving, due to a delay in a decrease in a gray scale of a background in a rear direction of the ball, a phenomenon in which an image of the ball leaving a bright trail in its rear direction is displayed occurs remarkably, thus causing an image quality to become lower. On the other hand, in the case of using overshooting driving and reducing no number of bits of data, since a decrease in a gray scale occurs in the rear direction of the ball, an image of the ball leaves less trails and a maximum error of the overshooting gray scale is 0 gray levels, thus enabling an image quality to become higher.

Moreover, in the case of using overshooting driving and reducing the number of bits, that is, reducing the number of bits of data of an input from 6 to 4, since a maximum error of the overshooting gray scale is 2 gray levels in an increasing direction, an image of the ball leaves less trails, thus enabling an image quality to become higher. However, in the case of reducing the number of bits of data from 6 to 3, a maximum error in the overshooting gray scale is 5 gray levels in an increasing direction and, due to insufficient overshooting driving, an image of the ball leaves many trails, thus causing an image quality to become lower.

As shown in FIG. 12 and FIGS. 13A and 13B, when data of an input 1 being of 6 is converted to data of an input being 3 bits, an error in the overshooting gray scale becomes large and therefore an edge line of an image is highlighted or any effects of the overshooting driving are almost never obtained, however, if data of an input 1 being 6 bits is converted to data of an input being 4 bits, almost the same effect as can be obtained in the case of no reduction of the number of bits can be achieved.

Such results from the confirmation of effects by a visual check as described above show clearly that, by converting data of an input 1 being of 6 bits to data of an input being 4 bits, an image quality being almost equal to that obtained when input data is directly stored in the frame memory 3 can be achieved, thus enabling storage capacity of a frame memory to be greatly reduced.

Thus, in the liquid crystal display device of the present invention, by mounting a data converting table on an input side and by holding an input data, after having reduced its number of bits of input data, in a frame memory to cause the input data to be delayed by one frame period, memory capacity of the frame memory can be greatly reduced when compared with a case where input data is directly stored as it is. That is, when data of an input 1 being of 8 bits is converted to data of an input being 5 bits, for example, in the case of XGA (Extended Graphic Array) made up of 1024×768 pixels, if 8 bits are used, a capacity of 768 Kbytes is required, however, if 5 bits are used, a capacity of only 480 Kbytes is necessary. Moreover, when data of an input 1 being of 6 bits is converted to data of an input of being 4 bits, in the case of XGA made up of 1024×768 pixels, if 6 bits are used, a capacity of 576 Kbytes is necessary, however, if 4 bits are used, a capacity of only 384 Kbytes is necessary. Also, in the case of VGA (Video Graphic Array, 640×480 pixels) and SXCA (Super Extended Graphic Array, 1280×1024 pixels), memory capacity other than the XGA can be greatly reduced.

It is apparent that the present invention is not limited to the above embodiments but may be changed and modified without departing from the scope and spirit of the invention. For example, in a color liquid crystal display, by performing data conversion on gray-scale data including data for a red (R) color, green (G) color, and blue (B) color for an input 1 made up of 8 bits so that a number of bits for two colors including the red and blue colors becomes 5 and so that a number of bits for a green color having high visibility is 6, gray-scale data of an input 1 may be produced. Moreover, the present invention may be applied to all cases where a polarity reversing method is employed, that is, to a dot reversing method in which a polarity of a signal voltage is reversed alternately between an pixel electrode in odd-numbered order and an pixel electrode in even-numbered order for every scanning line, to a line reversing method in which a polarity of a signal voltage is reversed alternately for every scanning line, and to a frame reversing method in which a polarity of a signal voltage is reversed for every frame.

What is claimed is:

1. A liquid crystal display device for displaying an image on a liquid crystal panel, said liquid crystal display device comprising:

a first table to receive first input gray-scale data having a first number of bits while varying sampling intervals of the first input gray-scale data based on a value of the first input gray-scale data so as to produce first output gray-scale data having a second number of bits, less than the first number of bits;

a frame memory to produce second input gray-scale data by delaying the first output gray-scale data fed by said first table by one frame image display period of a liquid crystal panel; and a second table to produce second output gray-scale data, which is used to perform overshooting driving, based on the difference in the number of bits between the first input gray-scale data and the second input gray-scale data.

2. The liquid crystal display device according to claim 1, wherein said first table reduces the number of bits by performing data conversion such that, when the gray-scale value of the first input gray-scale data is small, the first output gray-scale data is produced at rough intervals, and such that, when the gray-scale value of the first input gray-scale data is large, the first output gray-scale data is produced at shorter and finer intervals.

3. The liquid crystal display device according to claim 2, wherein the first input gray-scale data comprise eight bits and the first output gray-scale data comprise five bits.

4. The liquid crystal display device according to claim 2, wherein the first input gray-scale data comprise six bits and the first output gray-scale data comprise four bits.

5. The liquid crystal display device according to claim 2, wherein the first input gray-scale data comprise six bits and the first output gray-scale data comprise three bits.

6. The liquid crystal display device according to claim 2, wherein the first input gray-scale data comprise red color data, green color data, and blue color data, each comprising eight bits, and the first output gray-scale data comprise red color data and blue color data, each comprising five bits, and green color data comprising six bits.

7. The liquid crystal display device according to claim 1, wherein said second table produces the second output gray-scale data by performing data conversion to convert the number of bits, corresponding to a gray-scale value larger than, equal to, or smaller than the gray-scale value of the first input gray-scale data, depending on whether the gray-scale value of the first input gray-scale data is larger than, equal to, or smaller than the gray-scale value of the second input gray-scale data that corresponds to the first input gray-scale data when data conversion to reduce the number of bits is not performed.

8. The liquid crystal display device according to claim 1, wherein said second table comprises a look-up table.

9. The liquid crystal display device according to claim 1, further comprising a liquid crystal panel to receive the second output gray-scale data from said second table.

10. The liquid crystal display device according to claim 9, wherein said liquid crystal panel comprises a Twisted Nematic (TN) type.

11. The liquid crystal display device according to claim 9, wherein said liquid crystal panel comprises an In-Plane Switching (IPS) type.

12. The liquid crystal display device according to claim 9, wherein said liquid crystal panel provides an image display by a dot reversing method.

13. The liquid crystal display device according to claim 9, wherein said liquid crystal panel provides an image display by a line reversing method.

14. The liquid crystal display device according to claim 9, wherein said liquid crystal panel provides an image display by a frame reversing method.

15. A method of operating a liquid crystal display device, said method comprising:

receiving first input gray-scale data having a first number of bits;

varying sampling intervals of the first input gray-scale data based on a value of the first input gray-scale data so as to produce first output gray-scale data having a second number of bits, less than the first number of bits;

delaying the first output gray-scale data by one frame image display period of a liquid crystal panel to produce second input gray-scale data;

producing second output gray-scale data, which is used to perform overshooting driving, based on the difference in the number of bits between the first input gray-scale data and the second input gray-scale data; and providing the second output gray-scale data to the liquid crystal display panel.

16. The method according to claim 15, wherein the first output gray-scale data is produced by reducing the number of bits by performing data conversion such that, when the gray-scale value of the first input gray-scale data is small, the first output gray-scale data is produced at rough intervals, and se such that, when the gray-scale value of the first input gray-scale data is large, the first output gray-scale data is produced at shorter and finer intervals.

17. The method according to claim 15, wherein the first input gray-scale data comprise eight bits and the first output gray-scale data comprise five bits.

18. The method according to claim 15, wherein the first input gray-scale data comprise six bits and the first output gray-scale data comprise four bits.

19. The method according to claim 15, wherein the first input gray-scale data comprise six bits and the first output gray-scale data comprise three bits.

20. The method according to claim 15, wherein the first input gray-scale data comprise red color data, green color data, and blue color data, each comprising eight bits, and the first output gray-scale data comprise red color data and blue color data, each comprising five bits, and green color data comprising six bits.

21. A liquid crystal display device for displaying an image on a liquid crystal panel, said liquid crystal display device comprising:

a first table to receive first input gray-scale data having a first number of bits while varying sampling intervals of the first input gray-scale data based on a value of the first input gray-scale data so as to produce first output gray-scale data having a second number of bits, less than the first number of bits;

a frame memory to produce second input gray-scale data by delaying the first output gray-scale data fed by said first table by one frame image display period of a liquid crystal panel; and a second table to produce second output gray-scale data, which is used to perform overshooting driving, based on the difference in the number of bits between the first input gray-scale data and the second input gray-scale data, wherein the liquid crystal panel receives the second output gray-scale data from said second table.

* * * * *